United States Patent [19]

Sakash et al.

[11] Patent Number: 4,534,301

[45] Date of Patent: Aug. 13, 1985

[54] INCINERATOR ASH REMOVAL SYSTEMS

[75] Inventors: George Sakash; Robert K. Grier, Jr.; Hansjoerg Stern; Abdul G. Dada, all of Wilmington; Daniel W. McKeel, Rocky Point, all of N.C.

[73] Assignee: General Electric Company, San Jose, Calif.

[21] Appl. No.: 618,690

[22] Filed: Jun. 8, 1984

[51] Int. Cl.[3] ..... F23G 3/00

[52] U.S. Cl. ..... 110/255; 110/259; 110/290; 110/291; 198/749; 414/198

[58] Field of Search ..... 110/255, 259, 290, 291; 414/198, 214; 198/736, 749

[56] References Cited

U.S. PATENT DOCUMENTS 1,939,366 12/1933 Preston ..... 110/291
3,033,348 5/1982 Andrew .
3,722,433 3/1973 Kramer ..... 110/255 X
3,790,007 2/1974 Sprague .
3,855,950 12/1974 Hughes, Jr. ..... 110/255 X
3,926,302 12/1975 Smith .

*Primary Examiner*—Edward G. Favors
*Attorney, Agent, or Firm*—Ivor J. James, Jr.; Samuel E. Turner; Raymond G. Simkins

[57] ABSTRACT

An incinerator is disclosed which includes apparatus for removing ash from an incinerating chamber and which comprises hydraulically operated plows that slide along the floor of the chamber to push the ash towards an ash trough. Ash removal efficiency is improved in accordance with the present invention by the hinged suspension of a brush from the plow face. An auxiliary plow is added to the waste material loading device to clear ash from the highest of several stepped floor levels even in the absence of no new load being entered. The auxiliary plow further includes a clevis assembly which pivots the brush away from the incinerator floor during reverse plow travel.

11 Claims, 9 Drawing Figures

INCINERATOR ASH REMOVAL SYSTEMS

The present invention relates in general to incinerators and more specifically to incinerators used to burn various kinds of combustibles wherein ash is removed effeciently.

BACKGROUND OF THE INVENTION

It is known to use an incinerator to burn combustible waste material that has been contaminated by radioactive substances. Through incineration the volume of the waste material is reduced to ash and recovery of radioactive particles is made possible. Any substantial accumulation in the incinerator of radioactive ash creates the danger that the ash will reach its critical mass. To obviate this problem, special apparatus is used in prior art incinerators for removing such ash. Generally, hydraulically operated plows which scrape the floor are utilized to push ash toward an ash trough for further collection. The use of such equipment raises the possibility that an excessive amount of radioactive ash may be retained beneath the plow as it retracts following its forward travel. If the radioactivity exceeds a predetermined level, the incinerator must be shut down for cleaning. Such a shut-down results in the loss of useful operating time and thus lowers the overall efficiency of the operation.

In many prior art incinerators, the burning waste material is successively moved down a series of stepped levels inside the incinerating chamber. On the top level of the chamber, floor debris consisting of burning waste and whatever ash has accumulated, are cleared by the subsequently loaded waste material. In effect, the newly loaded waste pushes the old floor debris ahead of itself and down to the next floor level. Therefore, once the last load of waste has been placed into the incinerator and has been reduced to ash, partially or completely, the ash remains on the upper level and no means are provided for its removal.

OBJECTS OF THE INVENTION

It is a principal object of the present invention to provide a new and improved incinerator wherein the removal of ash is not subject to the foregoing disadvantages.

It is another object of the present invention to provide an incinerator for burning radioactively contaminated waste material, wherein a new and improved plow is used for the removal of debris and the amount of ash retained in the incinerator is reduced.

It is an additional object of the present invention to increase the efficiency of ash removal in an incinerator so as to extend the useful operating period between required incinerator shut-downs for clean-out and removal of accumulated radioactive material.

It is still a further object of the present invention to provide a new and improved incinerator wherein the removal of ash is completely independent of the additional loading of waste material.

SUMMARY OF THE INVENTION

These and other objects of the present invention are achieved in an incinerator having a new and improved ash removal system, wherein the frequency of shut-downs for required clean-up is materially reduced. Each plow which services a separate floor level has a metallic brush positioned on the plow face. The brush sweeps the floor of the incinerating chamber ahead of the plow, as the plow travels in the forward direction. When the plow travels in the reverse direction, the brush pivots upward away from the floor of the incinerating chamber in a manner which prevents ash from being carried back underneath the brush or under the plow. A further improvement of the efficiency of ash removal is obtained by the addition of an auxiliary plow for sweeping the highest level of the incinerating chamber where freshly loaded waste material is received. Consequently, the frequency of shut-down for clean-up is greatly reduced.

DESCRIPTION OF THE INVENTION

Figure 1:
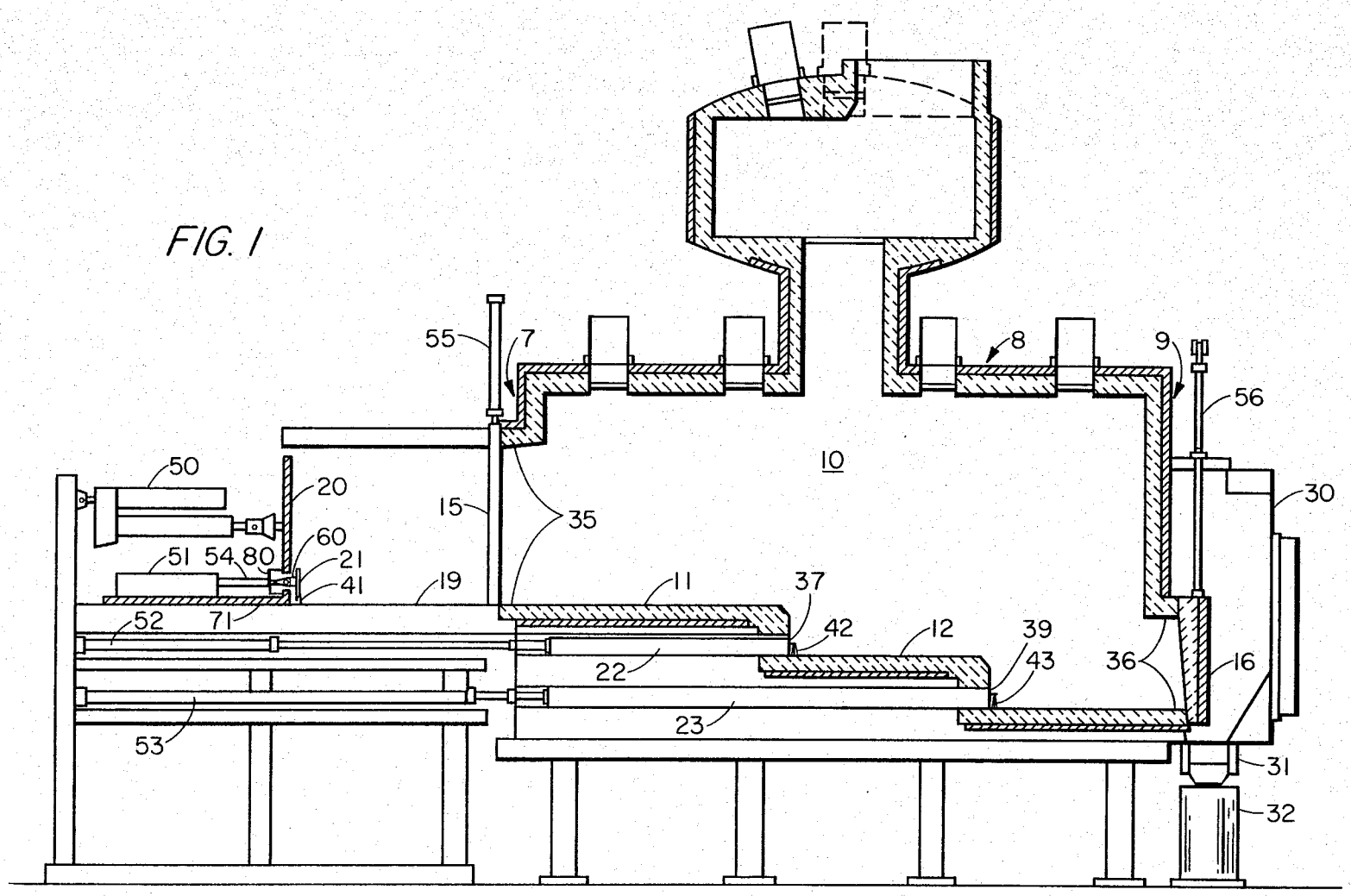
FIG. 1 shows an exemplary incinerator in vertical cross-section which illustrates salient features of the present invention.

Referring now to FIG. 1, incinerator 8 includes an incinerating chamber 10 which extends between substantially opposite chamber ends 7 and 9. Chamber 10 is seen to contain a stepped floor having a plurality of floor levels. As shown, floor levels 11, 12 and 13, descend between an input port 35 and an exit port 36. Each floor level is serviced by a separate plow. Thus, plows 21, 22 and 23 are capable of sliding over levels 11, 12 and 13 respectively, to scrape the latter. In a preferred embodiment of the invention, chamber 10 is uniform in width between opposite chamber ends 7 and 9 and the size of each plow is selected so that it substantially spans the width of the chamber.

A door 15, which may be operated by an hydraulic actuator 55, selectively closes input port 35 at the first chamber end 7. A door 16, which may be operated by an hydraulic actuator 56, is located at the second chamber end 9 and selectively closes exit port 36. As shown, externally of chamber 10 port 36 is completely enclosed by an enclosure 30. An ash trough 31 leads from enclosures 30 to a storage bin 32.

A set of hydraulic actuators 51, 52 and 53 is provided to slide plows 21, 22 and 23 respectively, across floor levels 11, 12 and 13 respectively. Each hydraulic actuator preferably includes at least one cylinder and an associated piston and rod, all well known in the art.

A loading platform 19 is seen to be substantially coplanar with the highest floor level 11 in the incinerating chamber. The platform is adapted to receive and hold combustible waste material which is to be reduced to ash in the incinerating chamber. A box ram 20 is adapted to be operated by an hydraulic actuator 50 similar in construction to the actuators described above. A push rod 54 extends through box ram 20 and terminates in an auxiliary plow 21 at one end thereof and in an hydraulic actuator 51 at its other end. Actuator 51 is carried by a platform 71 which forms part of the box ram and moves with the latter. Plow 21 carries a brush 41 on its face.

During the operation of the incinerator, combustible waste material is first loaded onto platform 19. During this phase of the operation, actuator 50 extends so as to push box ram 20 to the right in the drawing. The movement of box ram 20 causes the combustible material on platform 19 to be pushed onto the first step inside chamber 10, i.e. to level 11. Box ram 20 is then retracted and door 15 is closed to allow the combustible material to burn. Not all of the material on floor level 11 is reduced to ash during this stage of the operation. Thus, the debris on floor level 11 will contain both ash as well as unburned waste material. However, a large part of the material is reduced to ash and this allows additional waste material deposited on platform 19 to be loaded into chamber 10. As the new material is loaded, a large part of the debris on floor level 11 is displaced and is pushed the full length of step 11, down to floor level 12.

Figure 5:
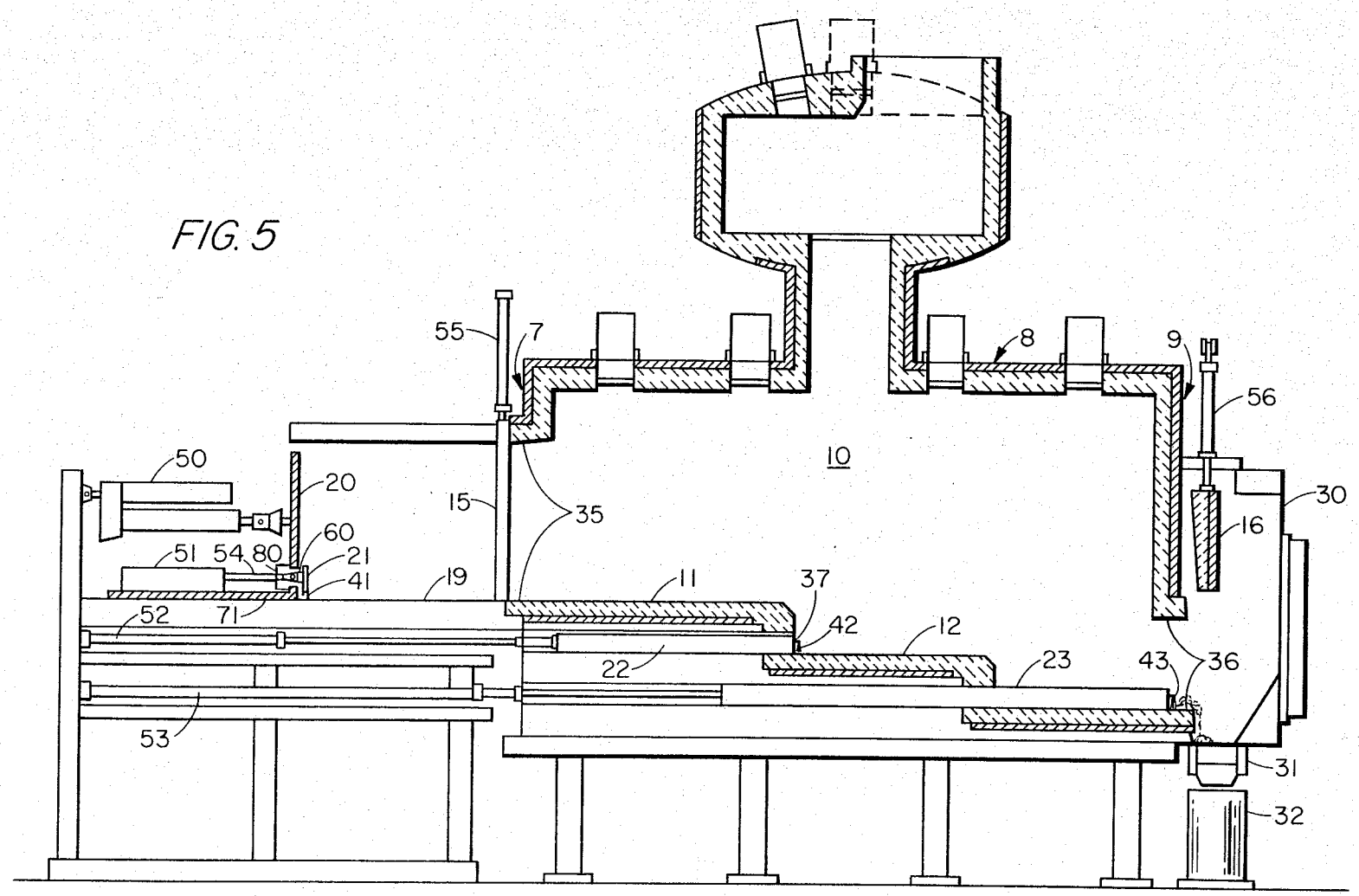
FIG. 5 shows a plow during forward travel on the lowest floor level of the incinerator.

Plows 22 and 23 are operated by hydraulic actuators 52 and 53 respectively, and serve to clear what is primarily ash from floor levels 12 and 13 respectively. Ash from floor level 12 is moved onto level 13 by plow 23. Ash from floor level 13 is cleared out of the chamber after door 16 is lifted by means of hydraulic actuator 56. Thus, the ash is moved through exit port 36 into ash trough 31 and storage bin 32, as best shown in FIG. 5. During this phase of the operation enclosure 30 prevents heat, gaseous products of combustion and ash from escaping into the surrounding atmosphere while door 16 is open.

Figure 2:
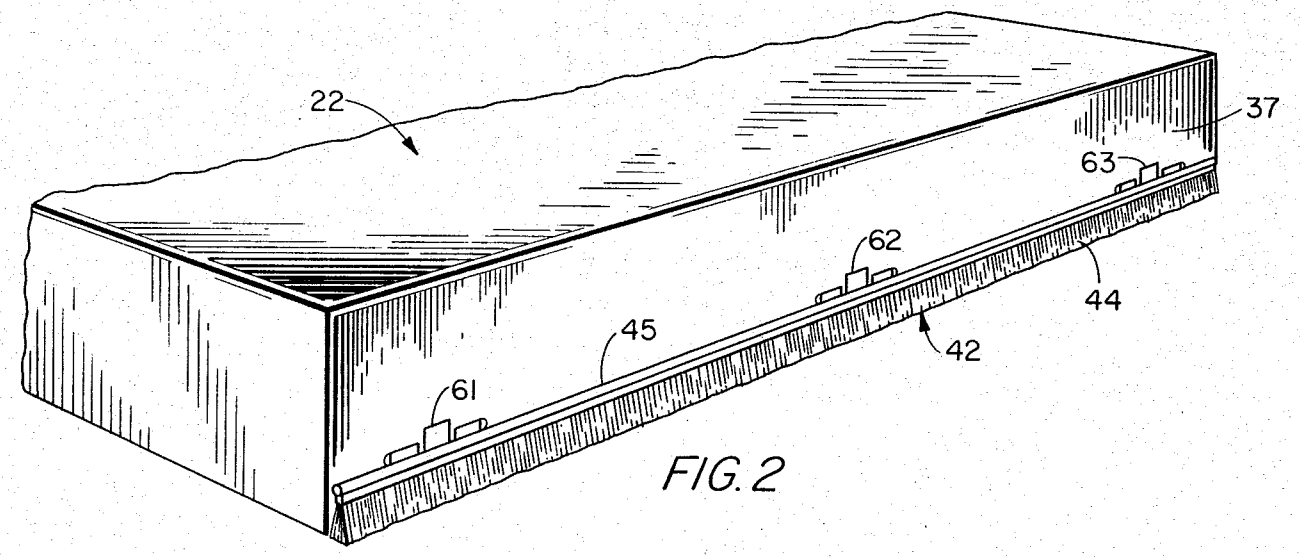
FIG. 2 illustrates a portion of the apparatus of FIG. 1 in greater detail.
Figure 3B:
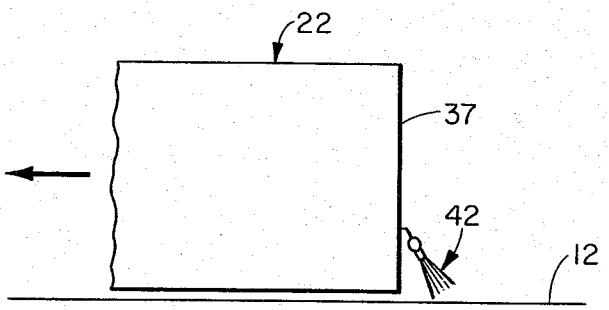
FIGS. 3(*a*) and 3(*b*) show the operating positions of the brush illustrated in FIG. 2 for forward and reverse movement of the plow.
Figure 3A:
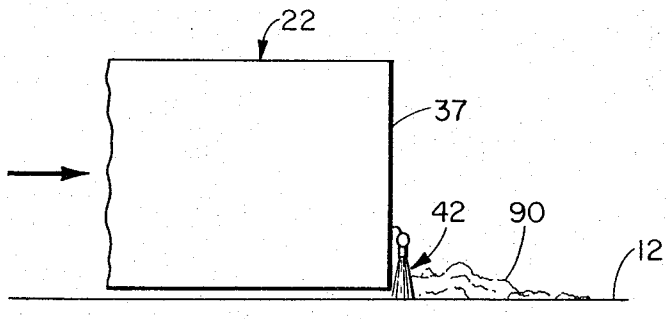
Figure 4:
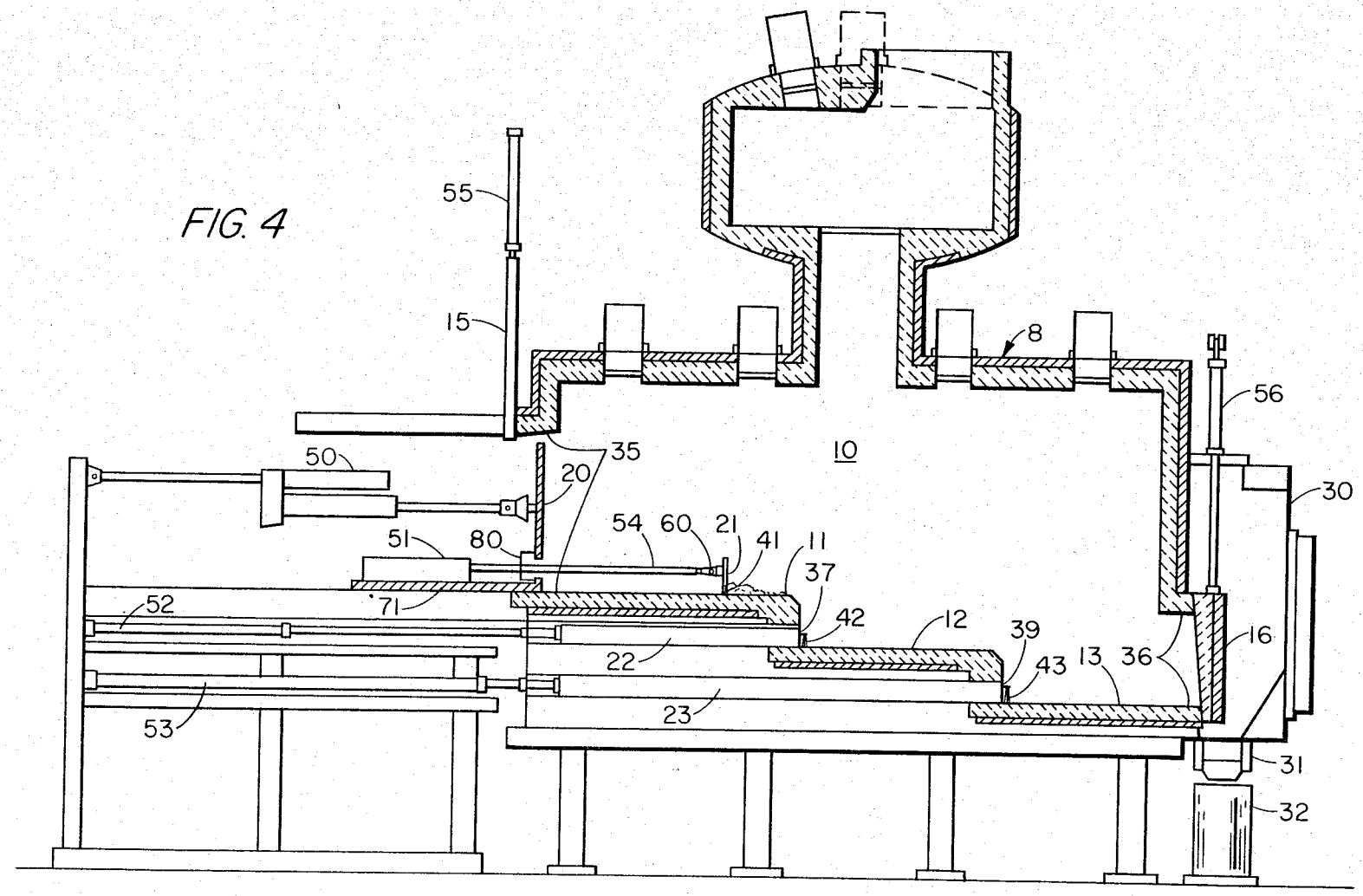
FIG. 4 shows the auxiliary plow during forward travel on the highest floor level of the incinerator.

As shown in FIGS. 1 and 4, each plow 22 and 23 has a plow face 37 and 39 respectively. As best illustrated in FIGS. 2 and 3, plow faces 37 and 39 have brushes 42 and 43 respectively attached thereto. Each brush is substantially coextensive in the long dimension with the plow face and each is hingedly suspended from its plow face. Thus brush 42 is attached to plow face 37 by means of hinges 61, 62 and 63, such that the bottom edge of the brush normally contacts floor level 12. In a preferred embodiment, the brushes have bristles, such as metallic bristles 44 of brush 42, which project from a stainless steel rod 45. The bristles may consist of 20 gauge wire and their density is sufficient to sweep substantially all ash on floor level 12 ahead of plow face 37 when plow 22 travels in the forward direction.

Referring now to FIG. 3, during the forward movement of plow 22, (movement to the right in FIG. 1), brush 42 is urged against plow face 37 and the brush bristles remain in constant contact with the floor. Thus, substantially all the ash particles designated by the numeral 90 are kept in front of the brush and hence in front of plow face 37. Upon subsequent retraction of actuator 52, plow 22 reverses direction, as shown in FIG. 3(*b*). At this time, brush 42 pivots on its hinges and tends to rise upward from floor level 12. Although some brush bristles still contact the floor during this reverse travel, such ash as is located behind brush 42, (to the left in FIG. 3(*b*)), will tend to remain in place rather than be drawn to the left. The preferred material for bristles 44 is material which is commercially available as Inconel ®, which has the ability to resist heat and corrosion in the incinerator environment.

A further feature of the present invention is best illustrated in FIG. 4. As explained above, hydraulic actuator 51, which operates auxiliary plow 21, is carried by platform 71 of box ram 20. Push rod 54 extends through housing 50 in the box ram and has auxiliary plow 21 attached to its end. With actuator 50 extended as shown, so as to place box ram 20 at input port 35 of chamber 10, auxiliary plow 21 may be moved further to the right by means of its actuator 51 to cause brush 41 to sweep floor level 11. When actuator 51 is retracted, housing 80 received a clevis assembly 60, which connects push rod 54 to plow 21.

During the forward travel of auxiliary plow 21 (to the right in FIG. 1), plow 21 has a substantially vertical orientation. However, during reverse travel the auxiliary plow tilts to the orientation shown in FIG. 7, such that brush 41 is lifted off the floor. The tilting action of auxiliary plow 21 is implemented by clevis assembly 60.

Figure 7:
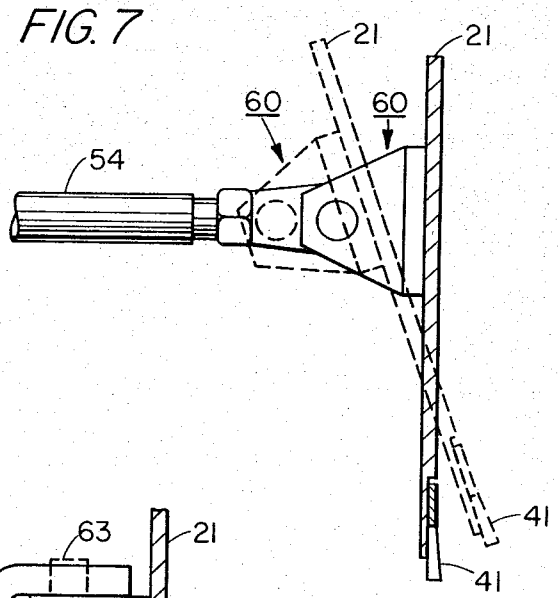
FIG. 7 shows the plow of FIG. 6 oriented for reverse plow travel.
Figure 6B:
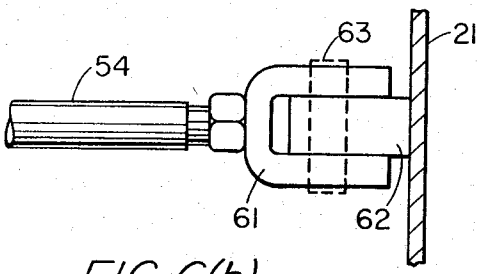
FIGS. 6(*a*) and 6(*b*) show the auxiliary plow of FIG. 4 in greater detail.
Figure 6A:
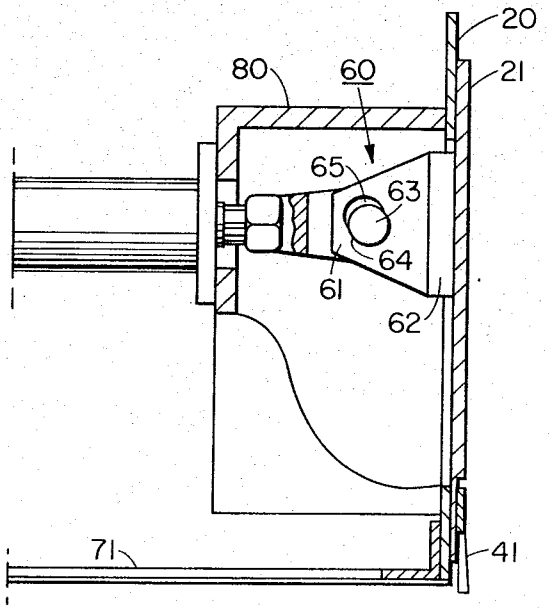

Clevis assembly 60 is best illustrated in FIGS. 6 and 7, FIGS. 6(*a*) and 6(*b*) giving top and elevation views respectively of the forward-traveling auxiliary plow, while FIG. 7 shows the auxiliary plow during travel in the reverse direction. FIG. 6(*a*) shows the mechanism partly in cross section. Clevis 61 is connected to push rod 54 and contains a pair of holes for rigidly holding a pin 63. An eye bracket 62 projects from plow 21 and contains a bore 64 which receives pin 63. Bore 64 has the shape shown in FIG. 6(*a*) which allows eye bracket 62 and plow 21 to pivot during the reverse travel of auxiliary plow 21. During this reverse motion, pin 63 attempts to ride up into area 65 of bore 64, causing eye bracket 62 to pivot as shown in FIG. 7.

In prior art incinerators, i.e. where no auxiliary plow and no brushes are used, ash removal efficiency, i.e. the amount of ash removed as a percentage of the amount of ash produced, approximates 40%. The addition of brushes to plows 22 and 23 as described herein, increases ash removal efficiency to approximately 60%. By using both the auxiliary plow 21 and the brushes in accordance with the present invention, ash removal efficiency may be increased up to 90%–95%. As a result, the frequency of shut-downs for clean-up of the incinerator is materially reduced and the danger of a build-up of radioactive material is lessened.

While a preferred embodiment of the present invention has been shown and described herein, it will be clear that the invention is not so limited. Numerous variations, changes, departures, substitutions and partial and full equivalents will now occur to those skilled in the art without departing from the invention herein. Accordingly, it is intended that the invention be limited only by the spirit and scope of the appended claims.

What is claimed is:

1. An incinerator wherein combustible material is reduced to ash, comprising:

an incinerating chamber of substantially uniform width having first and second substantially opposite chamber ends;

means for loading said combustible material into said chamber at said first chamber end;

means for receiving said ash from said chamber at said second chamber end;

at least one plow positioned inside said chamber adapted to travel at least a portion of the distance between said opposite chamber ends in sliding contact with the chamber floor, said plow including a plow face substantially spanning said chamber width; and a brush comprising metallic bristles hingedly suspended on said plow face so as to normally make contact with said floor, said brush being substantially coextensive with said plow face in the direction of said chamber width, said brush being adapted to sweep floor debris ahead of said plow face during forward plow travel toward said second chamber end and to prevent said debris from being carried back during reverse plow travel;

whereby said ash in said chamber is moved substantially only toward said ash receiving means.

2. An incinerator in accordance with claim 1 wherein said chamber includes a selectively closable input port at said first chamber end for receiving said combustible material.

a selectively closable exit port at said second chamber end; and said ash receiving means comprising an ash enclosure substantially completely enclosing said exit port externally of said chamber and being adapted to communicate with said chamber through said exit port, said ash enclosure terminating in an ash trough positioned to collect ash swept out through said exit port.

3. An incinerator in accordance with claim 1 and further including means for hydraulically moving said plow in the direction of plow travel.

4. An incinerator in accordance with claim 1 wherein the hinged suspension of said brush on said plow face allows said brush to pivot upward from said floor during said reverse plow travel.

5. Apparatus in accordance with claim 1 wherein said chamber floor descends in steps between said ports, each of said steps presenting a separate floor level having substantially the width of said chamber;

a plow corresponding to each of said steps adapted to travel the full length of said step in sliding contact with the floor level thereof;

whereby floor debris is swept over the edge of each step by the brush suspended on the corresponding plow face, said debris traveling down successive steps toward said exit port during the forward travel of said plows.

6. An incinerator wherein combustible material is reduced to ash, comprising:

an incinerating chamber of substantially uniform width having first and second substantially opposite chamber ends;

said chamber including a plurality of floor levels of substantially the width of said chamber descending stepwise between said first and second chamber ends;

means for loading said combustible material at said first chamber end onto the highest floor level of said chamber;

means for receiving said ash at said second chamber end from the lowest floor level of said chamber;

a separate plow positioned on each of said floor levels adapted to travel the full length of each step in sliding contact with the corresponding floor level, each of said plows including a plow face spanning substantially said chamber width; and a brush comprising metalic bristle positioned on each plow face, each of said brushes being substantially coextensive with its corresponding plow face in the direction of said chamber width and being normally in contact with its corresponding floor level, each of said brushes being adapted to sweep floor debris ahead of the corresponding plow face during forward plow travel toward said second chamber end and to prevent said debris from being carried back during reverse plow travel;

whereby said ash in said chamber is moved down successive floor levels toward said ash receiving means.

7. An incinerator in accordance with claim 6 and further including means for hydraulically moving each of said plows in the direction of plow travel.

8. An incinerator in accordance with claim 6 wherein all plows below the highest floor level are positioned inside said chamber;

said loading means including an auxiliary plow being adapted to travel through said input port into said chamber to sweep said highest floor level; and means for tilting said auxiliary plow so as to raise said brush off its floor level during reverse travel of said auxiliary plow.

9. An incinerator wherein combustible material is reduced to ash, comprising:

an incinerating chamber of substantially uniform width having first and second substantially opposite chamber ends;

means for loading said combustible material into said chamber at said first chamber end including a selectively closable input port at said first chamber end for receiving said combustible material;

means for receiving said ash from said chamber at said second chamber end including a selectively closable exit port at said second chamber end;

means for receiving ash comprising an ash enclosure substantially completely enclosing said exit port externally of said chamber and being adapted to communicate with said chamber through said exit port, said ash enclosure terminating in an ash trough positioned to collect ash swept out through said exit port;

at least one plow positioned inside said chamber adapted to travel at least a portion of the distance between said opposite chamber ends in sliding contact with the chamber floor, said plow including a plow face substantially spanning said chamber width and having means for hydraulically moving said plow in the direction of plow travel; and a metallic bristled brush hingedly suspended on said plow face so as to normally make contact with said floor, said brush being substantially coextensive with said plow face in the direction of said chamber width, said brush being adapted to sweep floor debris ahead of said plow face during forward plow travel toward said second chamber end and to pivot upward from the chamber floor during reverse plow travel to prevent said debris from being carried back during reverse plow travel;

whereby said ash in said chamber is moved substantially only toward said ash receiving means.

10. Apparatus in accordance with claim 9, wherein said chamber floor descends in steps between said ports, each of said steps presenting a separate floor level having substantially the width of said chamber;

a plow corresponding to each of said steps adapted to travel the full length of said step in sliding contact with the floor level thereof;

whereby floor debris is swept over the edge of each step by the brush suspended on the corresponding plow face, said debris traveling down successive steps toward said exit port during the forward travel of said plows.

11. An incinerator wherein combustible material is reduced to ash, comprising:

an incinerating chamber of substantially uniform width having first and second substantially opposite chamber ends;

said chamber including a plurality of floor levels of substantially the width of said chamber descending stepwise between said first and second chamber ends;

means for loading said combustible material at said first chamber end onto the highest floor level of said chamber;

means for receiving said ash at said second chamber end from the lowest floor level of said chamber;

a separate plow positioned on each of said floor levels adapted to travel the full length of each step in sliding contact with the corresponding floor level, each of said plows including a plow face spanning substantially said chamber width and having means for hydraulically moving in the direction of plow travel, all of said plows below the highest floor level being positioned inside the chamber;

a metallic bristled brush positioned on each plow face, each of said brushes being substantially coextensive with its corresponding plow face in the direction of said chamber width and being normally in contact with its corresponding floor level, each of said brushes being adapted to sweep floor debris ahead of the corresponding plow face during forward plow travel toward said second chamber end and to prevent said debris from being carried back during reverse plow travel whereby said ash in said chamber is moved down successive floor levels toward said ash receiving means; and said loading means including an auxiliary plow being adapted to travel through said input port into said chamber to sweep said highest floor level and means for tilting said auxiliary plow so as to raise said brush off its floor level during reverse travel of said auxiliary plow.

* * * * *